US012385202B2

(12) United States Patent
Plumer

(10) Patent No.: US 12,385,202 B2
(45) Date of Patent: Aug. 12, 2025

(54) SNOW REMOVAL APPARATUS AND METHOD

(71) Applicant: Nicholas Plumer, Boothbay, ME (US)

(72) Inventor: Nicholas Plumer, Boothbay, ME (US)

( * ) Notice: Subject to any disclaimer, the term of this patent is extended or adjusted under 35 U.S.C. 154(b) by 735 days.

(21) Appl. No.: 17/762,075

(22) PCT Filed: Oct. 12, 2020

(86) PCT No.: PCT/US2020/055292

§ 371 (c)(1),
(2) Date: Mar. 20, 2022

(87) PCT Pub. No.: WO2021/080807

PCT Pub. Date: Apr. 29, 2021

(65) Prior Publication Data

US 2022/0389674 A1 Dec. 8, 2022

Related U.S. Application Data

(60) Provisional application No. 62/926,056, filed on Oct. 25, 2019.

(51) Int. Cl.

| | |
|---|---|
| ***E01H 5/06*** | (2006.01) |
| ***E01H 5/07*** | (2006.01) |
| ***E01H 5/10*** | (2006.01) |

(52) U.S. Cl.

CPC ..... *E01H 5/076* (2013.01); *E01H 5/061* (2013.01)

(58) Field of Classification Search

CPC ..... E01H 5/061; E01H 5/076; E01H 5/12; E01H 5/106; E01H 5/104; E01H 5/02;
(Continued)

(56) References Cited

U.S. PATENT DOCUMENTS

| | | | |
|---|---|---|---|
| 3,911,601 | A | 10/1975 | Maheu |
| 4,164,820 | A | 8/1979 | Krickovich |

(Continued)

FOREIGN PATENT DOCUMENTS

| | | |
|---|---|---|
| CA | 2227453 | 3/1998 |
| DE | 2359200 | 6/1975 |

(Continued)

OTHER PUBLICATIONS

International Search Report and Written Opinion in corresponding PCT application PCT/US2020/055292, Apr. 22, 2021, 13 pp.

*Primary Examiner* — Christopher J Sebesta
*Assistant Examiner* — Robert E Pezzuto
(74) *Attorney, Agent, or Firm* — Caseiro Burke LLC; Chris A. Caseiro; Nicholas A. McCrillis

(57) ABSTRACT

A snow removal apparatus and related method for removing snow from an underlying surface. The apparatus includes a plow blade arranged to stand off from the underlying surface when the apparatus is in use, a first air transport unit for delivering forced air into an air blade plenum and a second air transport unit for delivering forced air to a Venturi vacuum jet. The air blade plenum is arranged to deliver air to the underlying surface to lift snow located thereon. The Venturi vacuum jet is arranged to push air and lifted snow into and through a collection chute. Use of the apparatus results in a cleaner roadway that results per pass at a higher speed with less need for the use of salt and/or sand and substantially less wear and tear on the roadway.

16 Claims, 6 Drawing Sheets

(58) Field of Classification Search
CPC ..... E01H 5/0818; E01H 5/101; E01H 5/0863; E01H 1/101; E01H 1/0818; E02F 3/9206
See application file for complete search history.

(56) References Cited

U.S. PATENT DOCUMENTS

| | | | | |
|---|---|---|---|---|
| 4,226,034 | A | 10/1980 | Benjamin et al. | |
| 4,271,617 | A | 6/1981 | Yoshizawa | |
| 4,372,169 | A | 2/1983 | Hughes | |
| 4,663,603 | A | 1/1987 | David | |
| 4,858,270 | A | 8/1989 | Boschung | |
| 4,885,852 | A | 12/1989 | Gudmundsson | |
| 5,140,763 | A | 8/1992 | Nichols, IV | |
| 6,367,175 | B2 | 4/2002 | Lewis et al. | |
| 7,823,303 | B2 * | 11/2010 | Nagamatsu | E02F 3/9206 37/270 |
| 9,284,702 | B2 * | 3/2016 | Lee | E01H 5/104 |
| 10,094,083 | B2 | 10/2018 | Wuillemin et al. | |
| 2005/0229354 | A1 | 10/2005 | Dinteman et al. | |
| 2011/0258887 | A1 | 10/2011 | Chu | |
| 2012/0255585 | A1 | 10/2012 | Kowalczyk | |
| 2012/0258411 | A1 * | 10/2012 | Anderson | F23D 17/002 431/202 |
| 2016/0053452 | A1 | 2/2016 | Treglown | |
| 2018/0245299 | A1 | 8/2018 | Kautzman | |
| 2020/0370258 | A1 * | 11/2020 | Noland | E01H 5/108 |

FOREIGN PATENT DOCUMENTS

| | | |
|---|---|---|
| GB | 1349939 | 4/1974 |
| KR | 10-1661248 | 9/2016 |

* cited by examiner

SECTION D-D

DETAIL F

SECTION E-E

SNOW REMOVAL APPARATUS AND METHOD

BACKGROUND OF THE INVENTION

1. Field of the Invention

The present invention relates to an apparatus for removing snow or debris from a substrate such as a road surface. More particularly, the present invention relates to a snow removal apparatus that effectively removes snow or other debris from a substrate while minimizing damage to the surface and maximizing the quality and quantity of snow removal.

2. Description of the Prior Art

Present ways to remove snow from roadways or other substrates involve the use of a structure that makes contact with the substrate wherein the structure is shaped or positioned to push the snow from that portion of the substrate in contact with the apparatus. That contact with the substrate can cause damage to the surface and to matter adjacent to the substrate. As an example, private, commercial and municipal snowplow operations employ trucks and tractors to support and move snowplow blades. Those snowplow blades are made of rigid material and may be singular and maneuverable or they may be split blades with two independently operable blades that can be manipulated up and down and angled. Generally, snowplow blades tend to be removably affixed to the front end of the vehicle although in some instances they may be supported on the undercarriage of certain types of tractors.

Regardless of the particular vehicle and the particular blade configuration, the blade devices are weighted or otherwise configured to remain in contact with the roadway so that a substantial portion of any snow accumulating on the roadway in the path of the blade is pushed aside sufficient to make the roadway passable. Given that most every roadway has some sort of imperfection, it is essentially a given that the roadway, the blade or both will be damaged over the course of a snow removal season. In addition, structures peripheral to the roadway are also exposed to blade contact including, but not limited to, guardrails, curbs, and paint striping. As a result, there is substantial repair work required after each snow removal season. That repair work includes maintenance for the plow blades due to wear and tear. In addition, the energy required to remove snow is minimized based on the resistance and friction associated with making contact with the underlying substrate.

On a smaller scale, snowblowers are also used to remove snow. However, they are operated at slower speeds than are snowplows, they generally remove substantially less snow per hour and their repair requirements are substantial. While snowblowers may have their place in a localized setting, they are not adequate for large-scale roadway snow removal.

What is needed is a snow removal apparatus that is configured to minimize substrate damage when in use without compromising the snow removal function. What is also needed is a snow removal apparatus that is configured to effectively remove snow in a manner that minimizes the energy required and damage to equipment and to the substrate while completing the function, removes more snow per pass and can move at higher speeds than can conventional snowplows. Such an apparatus may not be limited to removing snow only but may also be used to remove other substrate debris.

SUMMARY OF THE INVENTION

It is an object of the present invention to provide a snow removal apparatus that is configured to minimize substrate damage when in use without compromising the snow removal quality function. It is also an object to provide such a snow removal apparatus that is configured to effectively remove snow in a manner that minimizes the energy required to complete the snow removal function.

Currently, between ¼ inch and two inches of snow is left on portions of the roadway between passes and covered with salt and/or sand to increase traction. The present invention is capable of removing all snow on the roadway between passes at a higher rate of speed that accomplishes more clearing per hour. A benefit of the invention is the cleaner roadway that results per pass at a higher speed with less need for the use of salt and/or sand. The ability to proceed at higher speed helps force air and lift snow into the invention's chute to move that snow off the roadway. The air pressure and volume of air delivered by the invention to snow on the roadway is proportional to the velocity of the vehicle propelling the invention.

These and other objects are achieved with the present invention, which is an apparatus that causes the displacement of snow from the roadway without making direct physical contact with the roadway. Instead, the invention establishes an invisible "blade of air" in the form of a forced air port that directs a pressure front of air at high velocity sufficient to dislodge and lift snow from the roadway surface. A second vacuum port draws dislodged and lifted snow into the apparatus's housing using Bernoulli's Principle and the Venturi effect. That is, a second port is used to push air through a linear shaped ejector jet at a rate sufficient to produce a vacuum to draw the lifted snow into a chamber referred to herein as a collection chute or an exit chute. The housing includes one or more blowers and/or fans arranged to produce air flow in plenums associated with the air blade port and the vacuum port with an exit chute away from the roadway.

The apparatus also includes a conventional type of plow blade. That plow blade is used to push snow away that is at a selectable height above the roadway so that the blade does not contact the roadway directly. Instead, the air blade and the vacuum port remove the snow that remains in place below the bottom of the blade. The apparatus is of a selectable width.

DETAILED DESCRIPTION OF THE PRESENT INVENTION

Figure 1:
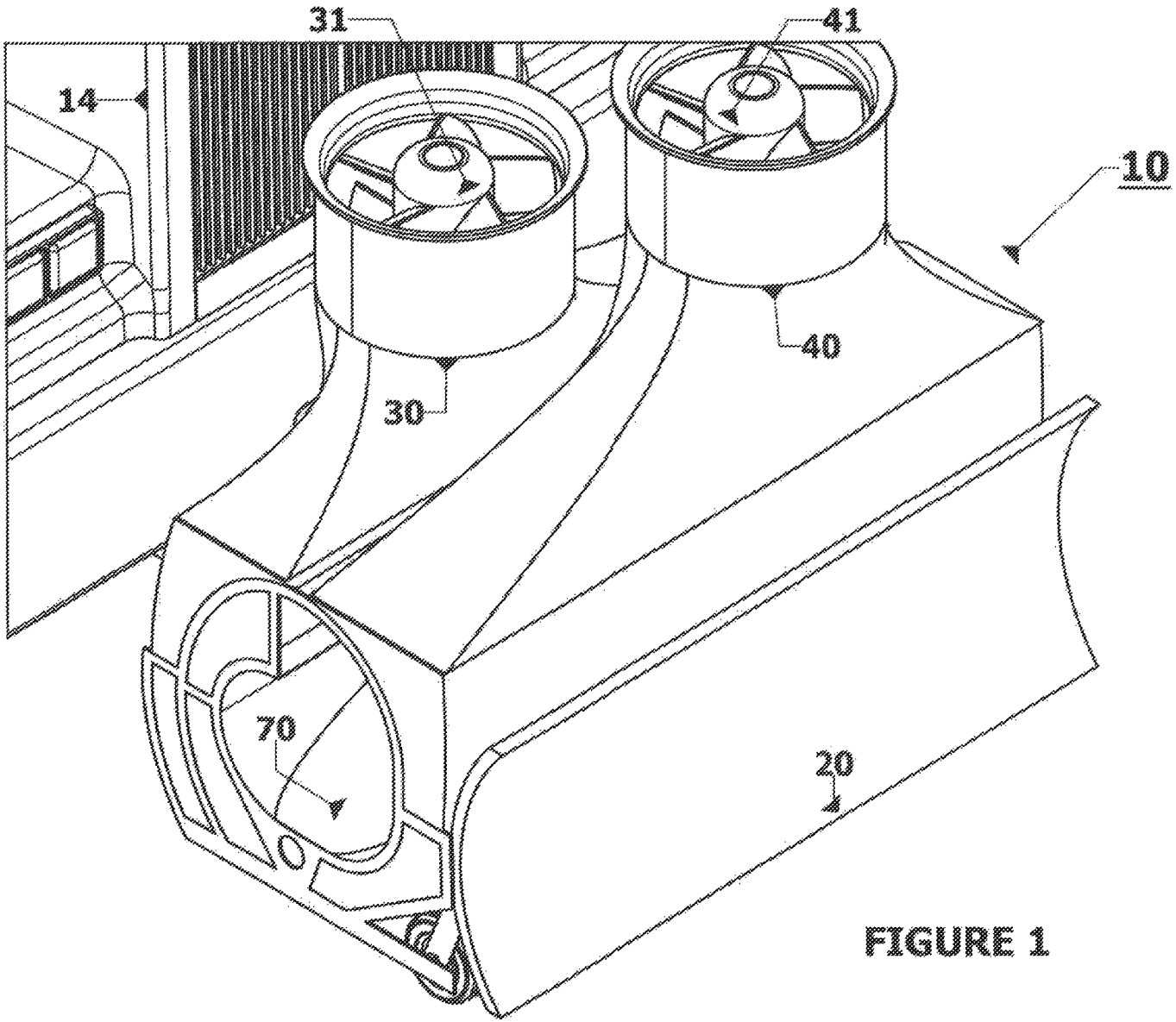
FIG. 1 is an isometric front view of the snow removal apparatus of the present invention attached to a vehicle that can be used to move the apparatus.
Figure 2:
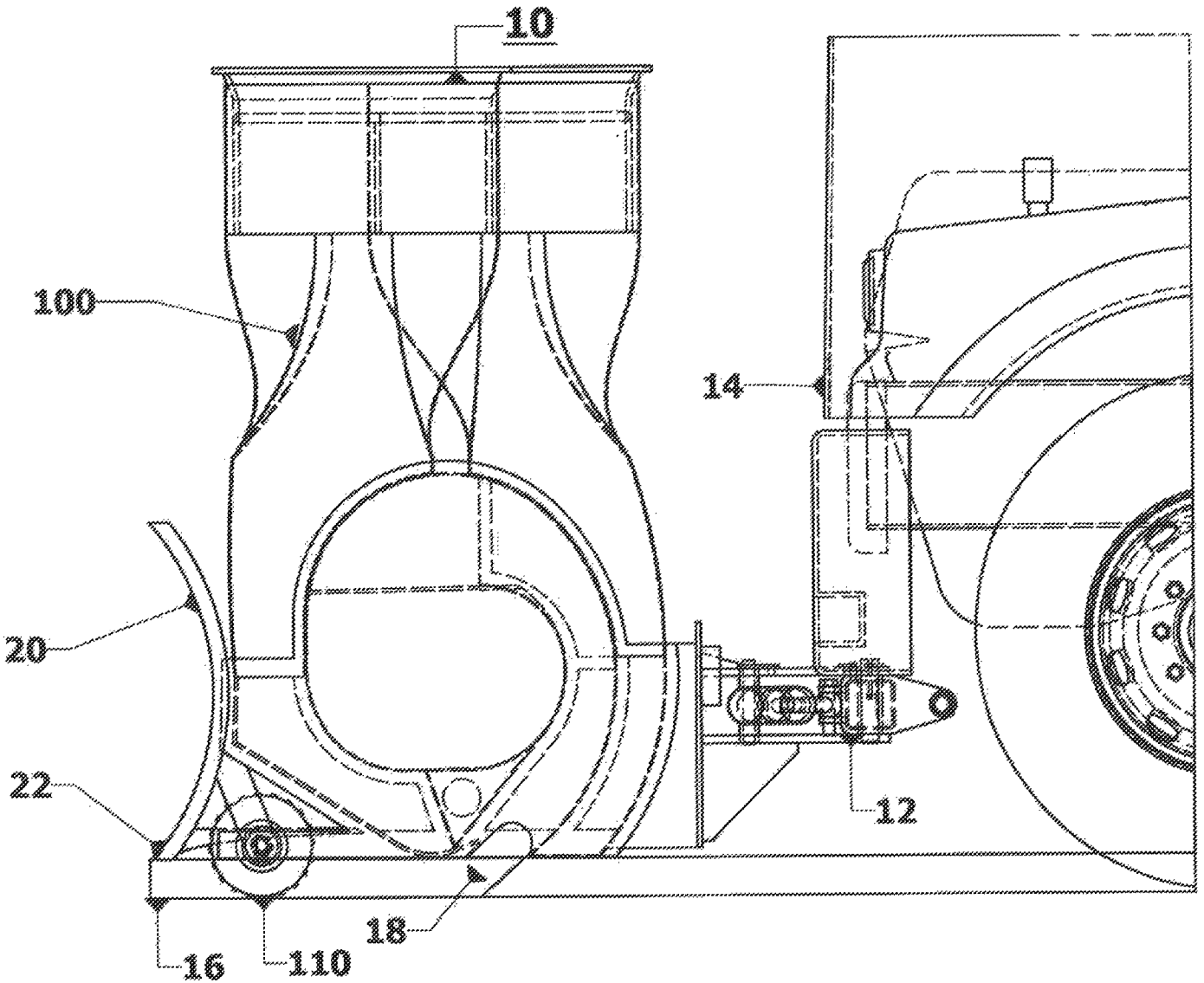
FIG. 2 is a side view of the present invention attached to the vehicle showing the roadway traffic side of the apparatus.
Figure 3:
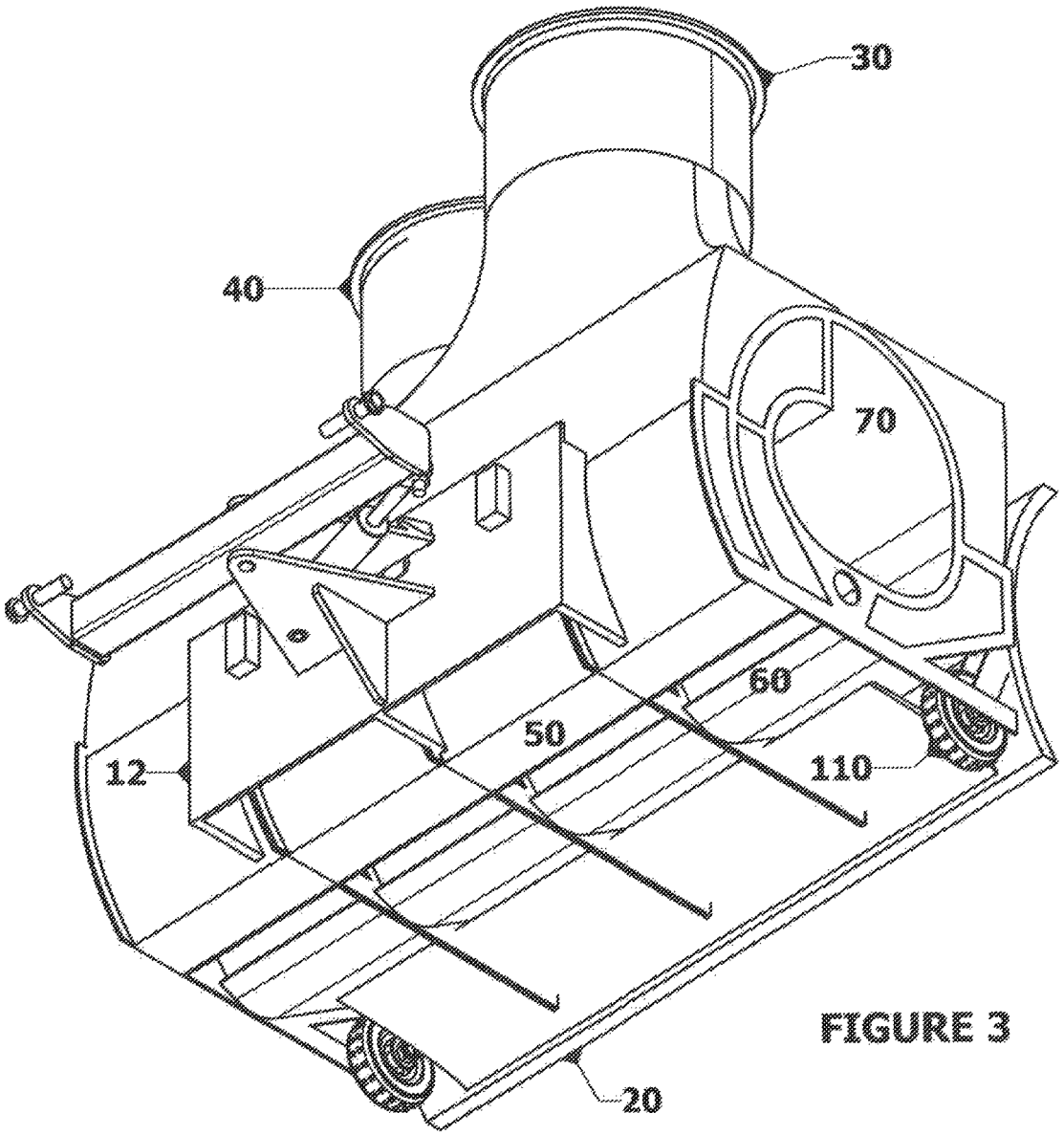
FIG. 3 is a rear bottom isometric view of the apparatus on the roadway shoulder side of the apparatus.
Figure 4:
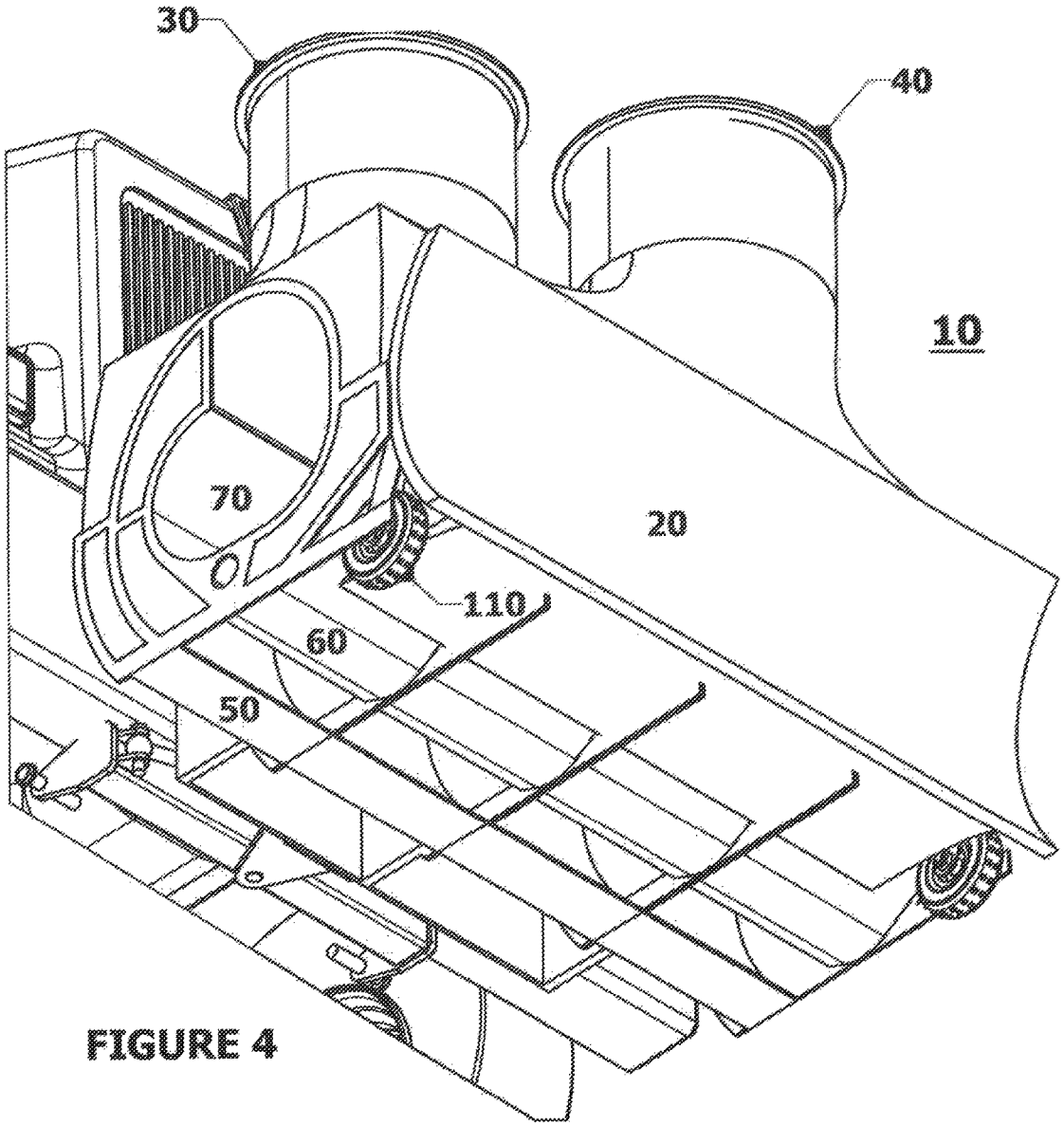
FIG. 4 is a front bottom isometric bottom view of the apparatus on the roadway shoulder side of the apparatus.
Figure 5:
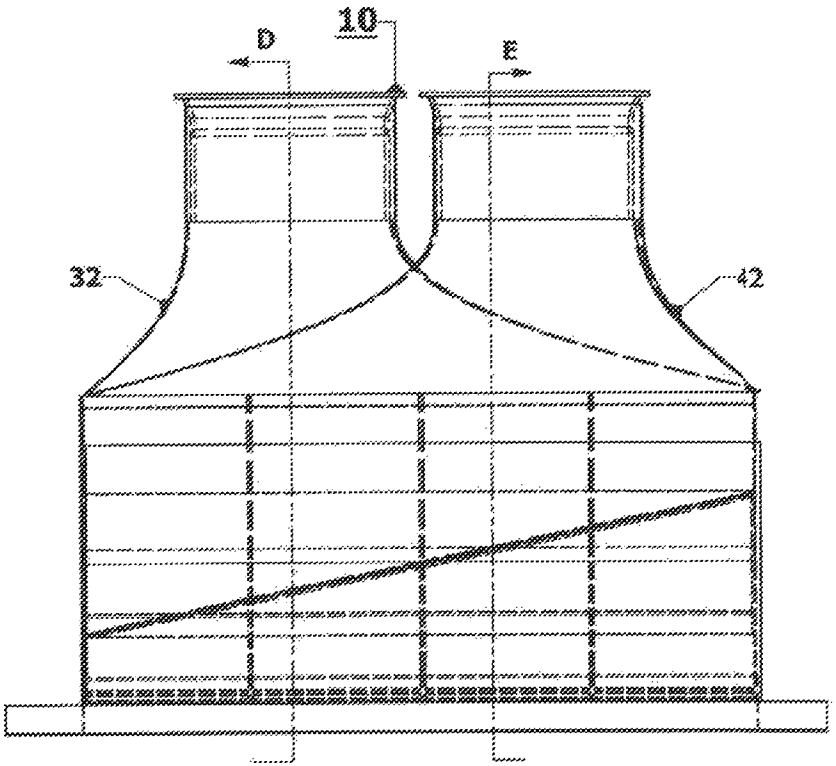
FIG. 5 is a front view of the apparatus.
Figure 6:
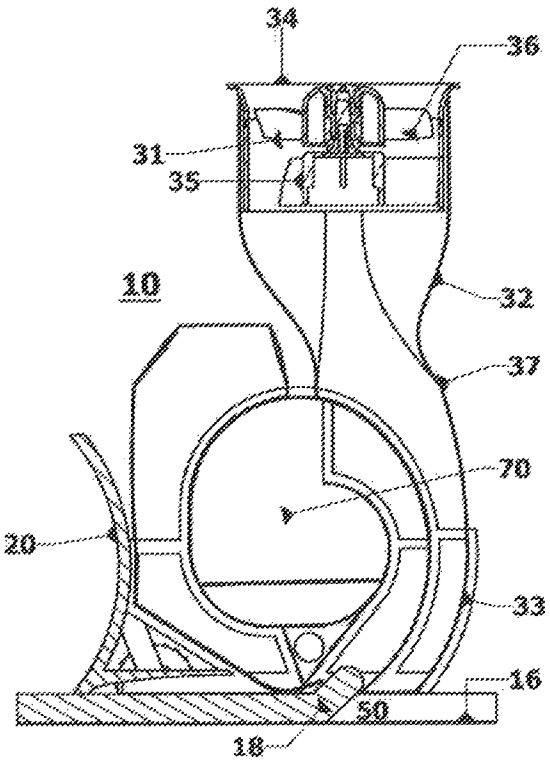
FIG. 6 is a first sectional side view of the apparatus.
Figure 8:
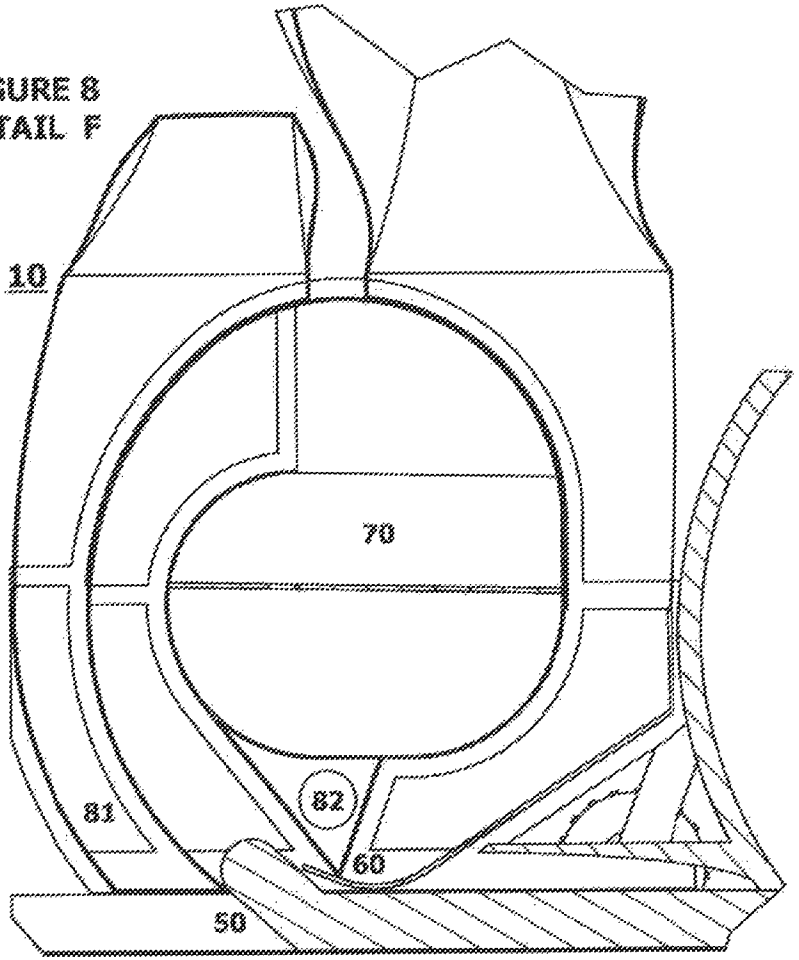
FIG. 8 is a third sectional side view of the apparatus.
Figure 7:
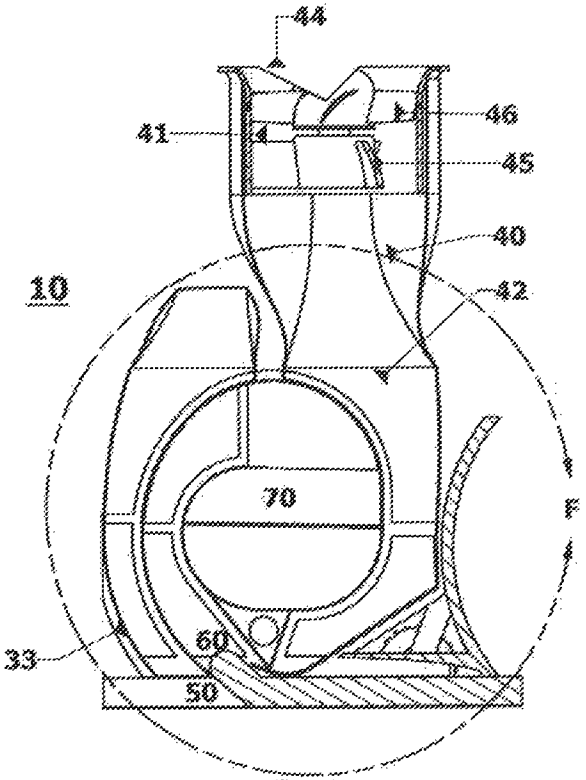
FIG. 7 is a second sectional side view of the apparatus.

A snow removal apparatus 10 of the present invention is shown in FIGS. 1-8. The apparatus 10 is removably attachable by a coupling 12 to a vehicle 14, wherein the vehicle 14 may be used to transport the apparatus 10 over a roadway surface 16 covered with snow 18. The coupling 12 may be a typical adapter of the type used to attach a plow to a vehicle. The apparatus 10 is used to remove the snow from the surface 16. It is contemplated that the apparatus 10 may be used to remove other material residing on the surface 16 not limited to the snow 18. While the apparatus 10 is shown attached to the front of the vehicle 14, it is to be understood that the apparatus 10 may be towed behind a vehicle such as vehicle 14 but not limited thereto. That is, the apparatus 10 may be coupled to the front of a vehicle or to the rear of a vehicle.

The apparatus 10 includes a plow 20 a first air transport unit 30, a second air transport unit 40, a blade of air outlet 50, a Venturi vacuum jet 60 and a collection chute 70. The components of the apparatus 10 are arranged to remove an upper portion of the snow 18 with the plow 20, lift the remaining portion of the snow 18 in contact with the surface 16 using the first air transport unit 30 and the blade of air outlet 50, and pushes the lifted snow into the collection chute 70 using the second air transport unit 40 and the Venturi vacuum jet 60. The lifted snow located in the collection chute 70 will be forced out of the apparatus 10 through an open end thereof adjacent to the shoulder side of the roadway via gravity and accumulated air pressure.

The plow 20 may be of any type suitable for snow removal. It is removably attachable to housing 100 that contains the collection chute 70. One or more offset wheels 110 are removably attached to the housing 100 and/or the plow 20 in an arrangement that maintains plow bottom 22 raised above the surface 16 while the apparatus 10 is in use. The positioning of the plow bottom 22 above the surface 16 is selectable based on the extent to which the one or more offset wheels 110 lift the plow 20 but it should be raised sufficiently to minimize the possibility of having the plow 20 make direct contact with the surface 16 when the apparatus 10 is in use.

The first air transport unit 30 is positioned above or adjacent to the collection chute 70 and includes a blower assembly 31, an air delivery plenum 32 and a blade plenum 33. The first air transport unit 30 is arranged so that blower assembly 31 is operated to draw air into blower inlet 34 for entry into the air delivery plenum 32. The blower assembly 31 includes a motor or other Power Delivery System (PDS) 35 and blades, impeller, airscrew or other compressor 36, now referred to as a blower. The blower assembly 31 is operable by one or more controllers coupled to a console and/or computer within the vehicle 14 so that activation of the PDS 35 causes the blower 36 to move in a direction that draws air into the inlet 34. The air delivery plenum 32 is shaped to cause the incoming air to be distributed along the width of the apparatus 10, corresponding approximately with the selectable width of the plow 20.

The air delivery plenum 32 transitions at location 37 to the blade plenum 33. The blade plenum 33 is of a shape having a width substantially the same as the width of the air delivery plenum 32 but a continually decreasing cross sectional area into the blade plenum 33. This narrowing to the blade plenum 33 quickly accelerates the velocity of the air located therein so that when the air exits the blade plenum 33 at the blade of air outlet 50 it is at a high rate of speed. The blade of air outlet 50 is shaped as a narrow outlet located above but in close proximity to the surface 16 and that narrow outlet extending approximately the width of the apparatus 10 causes air exiting through it to do so at a rate of speed sufficient to lift the snow 18 on the surface 16. That is, the air from the blade of air outlet 50 effectively scrapes the snow 18 from the surface 16 thereby lifting it from the surface 16. The PDS 35 may be 20 HP or more but is not limited thereto and it may be hydraulic, gas or electrically powered. The fan blades 36 may operate at a speed of about 3000 RPM sufficient to produce 30,000 CFM. Likewise, if a compressor is used it will operate at greater than 100 CFM and 75 PSI but is also not limited thereto. The fan blades 36 may be covered with a mesh that is about ⅛-inch at the fan inlet 34 but not limited thereto, the outlet 50 should be half to twice again bigger to allow foreign particles to exit. An air compressor will be provided with filtered air sufficient as to not allow contaminants into the airflow which could damage the blower. If compressed air is used then a temperature controlling device consisting of heating or cooling coils of electric, gas or liquid circulation may be implemented in plenum 81 or adjacent, to control frost accumulation.

Once the snow 18 has been lifted by the air from the blade of air port 50, it is pushed into the collection chute 70 using the second air transport unit 40. The second air transport unit 40 is also positioned above or adjacent to the collection chute 70 and is spaced from the first air transport unit 30. The second air transport unit 40 includes a blower assembly 41, an air direction plenum 42 and a vacuum plenum 43. The second air transport unit 40 is arranged so that blower assembly 41 is operated to draw air from the blower inlet 44 into the air direction plenum 42. The blower assembly 41 includes a PDS 45 and blower 46. The blower assembly 41 is operable by one or more controllers coupled to a console within the vehicle 14 so that activation of the PDS 45 causes the blower 46 to move in a direction that draws air into the inlet 44.

The blower assembly 41 may be similar to the blower assembly 31 and the two perform similarly by drawing air into their respective plenums for delivery to their respective outlets; namely, the blade outlet 50 for the blade plenum 33, and the Venturi vacuum jet 60 for the vacuum plenum 43. The blower inlet 44 may be covered in the manner described for blower inlet 34.

The air direction plenum 42 transitions at location 47 to the vacuum plenum 43. The vacuum plenum 43 is of a shape having a width substantially the same as the width of the air direction plenum 42 but a continually decreasing cross sectional area into the vacuum plenum 43. This narrowing to the vacuum plenum 43 quickly accelerates the velocity of the air located therein so that when the air exits the vacuum plenum 43 at the Venturi vacuum jet 60 it is at a high rate of speed. The Venturi vacuum jet 60 is of a changeable size to accommodate air of various pressures. The Venturi vacuum jet 60 is shaped as a narrow outlet with the cross-sectional shape of a Delaval nozzle located above but in close proximity to the surface 16. The cross-section shape is not limited to that Delaval nozzle shape. The air direction plenum 42 is shaped to enable the push of a substantial volume of air to the collection chute 70. The Venturi vacuum jet 60 is shaped as a flat and wide port located just within the collection chute 70 and it extends approximately the width of the apparatus 10. That narrowed configuration shaped like an ejector jet of extrusion or transverse linear ejector jet of converging-diverging shape produces a Venturi vacuum. The shape of the converging portion of the jet consists of a half angle of approximately 45° and the diverging portion of the jet diverges at a half angle of approximately 15°. A substantial vacuum (30 mbar) is created that draws air and the lifted snow entrained therein to move into the collection chute 70. Specifically, that air is pushed to the collection chute 70 via the Venturi vacuum jet 60 creating a high velocity air stream when it reaches the Venturi vacuum jet 60, creating a vacuum in its vicinity, thereby drawing the lifted snow into the collection chute 70, and then that air stream and gravity force collected snow out of the shoulder side of the collection chute 70. All of that snow is pushed out of the collection chute 70, which slides down the ramp that is installed transverse to apparatus 10 in chute 70.

The collection chute 70 is arranged to be filled with fast moving air and lifted snow and it is also arranged to permit that snow to be forced out. The collection chute 70 is arranged to be positioned at a diagonal, downwardly from the roadway side of the apparatus 10, which side is elevated and closed off or otherwise arranged to prevent snow from exiting that portion of the collection chute 70. The other side of the collection chute 70, the roadway shoulder side of the apparatus 10, is below the level of the roadway side and is open ended. The fast-moving air entering the collection chute 70 from the vacuum plenum 43 pushes the snow down and out of the collection chute 70 wherein there is a relatively lower air pressure at that end of the collection chute 70. The weight of the snow at the higher roadway-side of the collection chute 70 also causes the snow to slide down and out of the collection chute 70. If compressed air is used then a temperature controlling device consisting of heating or cooling coils of electric, or gas or liquid circulation mounted transverse to apparatus 10 inside of void 82, formed by the upper portion of Venturi vacuum jet 60, to control frost accumulation, to maintain un blocked air flow. The low point of plenum 43 prior to the Venturi vacuum jet 60 may also have a drain for back-draining accumulated liquid condensate.

It is to be understood that while a single blower is used to represent the blower assembly 31 of the first air transport unit 30, and a single blower is used to represent the blower assembly 41 of the second air transport unit 40, it is to be understood that other configurations for air transport are possible including, but not limited to, more than one blower for either or both of air transport units 30 and 40, or a single blower with divided function for air delivery in both plenums or multiple types of air delivery systems with discrete air pressure and air velocity performance characteristics. It may be necessary for two vacuum units to operate inline (dual stage) to create enough vacuum at a high enough flow rate. It is further to be understood that the apparatus 10 is of selectable width made dependent on the particular task to be performed. For example, the apparatus 10 may be wide enough to complete the clearing of a complete highway lane, or to complete the clearing of a sidewalk, with the vehicle 14 selected to be compatible with the size of the apparatus 10 and its particular function. The materials used to make the components of the apparatus 10 are selectable provided they are of sufficient structural integrity to perform the task of snow/debris removal and, optionally, over a selectable service life.

The apparatus 10 of the present invention enables efficient snow removal from an underlying surface without the need to make direct physical contact between a structural component such as a plow blade and that surface. The result is less damage to the surface, peripheral structures and the plow blade. The apparatus 10 described enables faster plow speeds with substantially complete snow removal and minimal damage as noted.

Although an embodiment of the present invention has been described herein, the above description is merely illustrative. Further modification of the invention herein disclosed will occur to those skilled in the respective arts and all such modifications are deemed to be within the scope of the invention as defined by the appended claims.

What is claimed is:

1. A snow removal apparatus for removing snow from an underlying surface, the apparatus comprising:

a plow blade coupled to a housing, wherein the housing is couplable to a vehicle and the plow blade is arranged to stand off from the underlying surface when the apparatus is in use;

a first air transport unit including a first blower and a first plenum;

a second air transport unit including a second blower and a second plenum;

a collection chute within the housing, wherein the collection chute is arranged to be positioned at a diagonal, downwardly from a roadway side of the apparatus such that the snow slides down and out of the collection chute at a roadway shoulder side of the apparatus;

a blade of air plenum extending from the first plenum and arranged to deliver air to the underlying surface to lift snow located thereon; and a Venturi vacuum jet extending from the second plenum positioned forward of the blade of air plenum and arranged to push air and lifted snow into the collection chute, wherein the first blower is operated to push air to the blade of air plenum and the second blower is operated to push air to a vacuum plenum.

2. The snow removal apparatus of claim 1 further comprising a set of wheels arranged to cause the plow blade to stand off from the underlying surface.

3. The snow removal apparatus of claim 1 wherein the blade of air plenum terminates with a blade of air port and the Venturi vacuum jet terminates with a vacuum port, wherein the blade of air port and the vacuum port are each configured with a flat and a wide shape.

4. The snow removal apparatus of claim 1 wherein the first blower and the second blower may each be comprised of more than one blower.

5. The snow removal apparatus of claim 1 wherein the apparatus is coupled to the vehicle, wherein the vehicle is selected to push the apparatus along a roadway.

6. The snow removal apparatus of claim 5 wherein the apparatus is coupled to the front of the vehicle.

7. The snow removal apparatus of claim 5 wherein the apparatus is coupled to the rear of the vehicle.

8. The snow removal apparatus of claim 1 wherein the Venturi vacuum jet is shaped as a narrow outlet with a cross-sectional shape of a Delaval nozzle.

9. The snow removal apparatus of claim 1 wherein the Venturi vacuum jet is of a converging-diverging shape, wherein a converging portion consists of a half-angle of approximately 45° and a diverging portion diverges at a half-angle of approximately 15°.

10. The snow removal apparatus of claim 1 further comprising a temperature controlling device located in an upper portion of the Venturi vacuum jet to control frost accumulation and maintain unblocked air flow.

11. The snow removal apparatus of claim 10 wherein the temperature controlling device is an electric heating coil or a gas or liquid circulator.

12. The snow removal apparatus of claim 1 further comprising a drain within the second plenum for draining accumulated liquid condensate therefrom.

13. A method of removing snow from an underlying surface of an apparatus, the method comprising the steps of:

pushing a portion of the snow from the underlying surface with a plow blade;

forcing air through a blade of air port of the apparatus onto remaining snow on the underlying snow with sufficient pressure to lift the remaining snow;

causing lifted snow to be directed into a collection chute of the apparatus; and exhausting the lifted snow from the collection chute, wherein the collection chute is arranged to be positioned at a diagonal, downwardly from a roadway side of the apparatus such that the snow slides down and out of the collection chute at a roadway shoulder side of the apparatus.

14. The method of claim 13 wherein the step of pushing a portion of the snow from the underlying surface leaves the remaining snow at a depth of about two to four inches.

15. The method of claim 13 further comprising the step of pushing air through a blade of air plenum to lift the remaining snow from the underlying surface.

16. The method of claim 15 further comprising the step of pushing air through a Venturi vacuum jet using Venturi vacuum principles to pull and then push the lifted snow into and out of the collection chute.

* * * * *